US006315864B2

(12) United States Patent
Anderson et al.

(10) Patent No.: US 6,315,864 B2
(45) **Date of Patent: *Nov. 13, 2001**

(54) CLOTH-LIKE BASE SHEET AND METHOD FOR MAKING THE SAME

(75) Inventors: Ralph L. Anderson, Marietta; Fritz Radwanski, Roswell; Henry Skoog, Roswell; Donald E. Waldroup, Roswell, all of GA (US)

(73) Assignee: Kimberly-Clark Worldwide, Inc., Roswell, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/960,739

(22) Filed: Oct. 30, 1997

(51) Int. Cl.[7] ..... D21H 27/00

(52) U.S. Cl. ..... 162/109; 162/112; 162/113; 162/115

(58) Field of Search ..... 162/109, 111, 162/112, 113, 115

(56) References Cited

U.S. PATENT DOCUMENTS

| | | | | |
|---|---|---|---|---|
| 3,821,068 | | 6/1974 | Shaw . | |
| 3,879,257 | | 4/1975 | Gentile et al. . | |
| 4,125,659 | * | 11/1978 | Klowak et al. | 162/113 |
| 4,442,161 | | 4/1984 | Kirayoglu et al. . | |
| 4,507,173 | * | 3/1985 | Klowak et al. | 162/112 |
| 5,009,747 | * | 4/1991 | Viazmensky et al. | 162/115 |
| 5,137,600 | | 8/1992 | Barnes et al. . | |
| 5,328,759 | | 7/1994 | McCormack et al. . | |
| 5,389,202 | * | 2/1995 | Everhart et al. | 162/115 |
| 5,529,665 | | 6/1996 | Kaun . | |
| 5,558,873 | | 9/1996 | Funk et al. . | |
| 5,614,281 | | 3/1997 | Jackson et al. . | |
| 5,674,590 | * | 10/1997 | Anderson et al. | 162/112 |

FOREIGN PATENT DOCUMENTS

WO 98/44181 10/1998 (WO) .

* cited by examiner

*Primary Examiner*—Peter Chin
(74) *Attorney, Agent, or Firm*—Dority & Manning, P.A.

(57) ABSTRACT

An improved cloth-like base web is disclosed. In particular, the base web of the present invention has a cloth-like look and feel and has improved absorbency. The base web is made by first hydroneedling a web containing pulp and/or staple fibers. A bonding material is then applied to at least one side of the web and the web is creped on at least one side. By combining a hydroneedling operation with a creping operation, a base web is produced that is strong, stretchable, very soft and absorbent.

44 Claims, 5 Drawing Sheets

CLOTH-LIKE BASE SHEET AND METHOD FOR MAKING THE SAME

FIELD OF THE INVENTION

The present invention is generally directed to liquid absorbent products, such as paper wiping products, baby diapers, personal care products, disposable garments, and the like. For instance, in one embodiment, the present invention is directed to paper wiping products that are not only strong, absorbent and soft, but also have the look and feel of cloth or linen.

BACKGROUND OF THE INVENTION

Absorbent products such as paper towels, industrial wipers, baby wipers, diapers, food service wipers, feminine products, and other similar products are designed to include several important properties. For example, the products should have good bulk, a soft feel and should be highly absorbent. The products should also have good strength even when wet and should resist tearing. Further, for most applications, the products should have good stretch characteristics, should be abrasion resistant and should not deteriorate in the environment in which they are used.

In the past, many attempts have been made to enhance and increase certain physical properties of paper wiping products and other similar articles. Unfortunately, however, when steps are usually taken to increase one property of a wiping product, other characteristics of the product may be adversely affected. For instance, in pulp fiber based wiping products, softness can be increased by decreasing or reducing interfiber bonding within the paper web. Inhibiting or reducing fiber bonding, however, adversely affects the strength of the product. In fact, perhaps the most difficult and complex problem to solve in designing a paper wiping product is the ability to increase softness without decreasing strength.

One particular process that has proven to be very successful in producing paper towels and other wiping products is disclosed in U.S. Pat. No. 3,879,257 to Gentile, et al., which is incorporated herein by reference in its entirety. In Gentile, et al., a process is disclosed for producing soft, absorbent, single ply fibrous webs having a laminate-like structure.

The fibrous webs disclosed in Gentile, et al. are formed from an aqueous slurry of principally lignocellulosic fibers under conditions which reduce interfiber bonding. A bonding material, such as a latex elastomeric composition, is applied to at least one surface of the web in a spaced-apart pattern. The bonding material provides strength to the web and abrasion resistance to the surface.

Once the bonding material is applied to at least one side of the web, the web can be brought into contact with a creping surface. Specifically, the web will adhere to the creping surface according to the pattern by which the bonding material was applied. The web is then creped from the creping surface with a doctor blade. Creping the web mechanically debonds and disrupts the fibers within the web, thereby increasing the softness, absorbency, and bulk of the web.

In one alternative embodiment disclosed in Gentile, et al., both sides of the paper web are creped after the bonding material has been applied.

The processes disclosed in Gentile, et al. have provided great advancements in the art of making disposable wiping products. It would be desirable, however, if the softness of the paper products disclosed in Gentile, et al. could be increased without substantially compromising the strength of the products. It would also be very desirable if more cloth-like wiping products could be produced. As paper wiping products have evolved, the softness, look and feel of the paper products have become increasingly more important.

Specifically, one of the primary purposes of disposable paper wiping products is to serve as a substitute for various cloth and textile fabrics. As such, it is very desirable to be able to design a high strength paper wiping product that has a softness, look and feel that closely assimilates cloth.

Thus, there currently remains a need for a paper wiping product that closely assimilates the look and feel of cloth. A need also exists for a cloth-like paper wiping product that has improved softness over conventional products while still remaining strong. A need further exists for a cloth-like paper wiping product that does not become as compressed when wet as conventional products and therefore also has the feel of a cloth product during use.

A need also currently exists for an improved method of producing a base web made from pulp fibers, staple fibers, and mixtures thereof for use not only in various wiping products, but also in other products that are required to absorb fluids. In this regard, a need exists for a base web having improved absorbency and improved fluid pickup capabilities. A need further exists for an improved process for orienting fibers in the Z direction within a base web in order to improve absorbency and other various characteristics.

SUMMARY OF THE INVENTION

The present invention recognizes and addresses the foregoing drawbacks and deficiencies of prior art constructions and methods.

Accordingly, it is an object of the present invention to provide an improved process for producing a base web made from pulp fibers, staple fibers, or mixtures thereof.

It is another object of the present invention to provide an improved liquid absorbent product.

Another object of the present invention is to provide an improved method for producing cloth-like paper wiping products.

It is another object of the present invention to provide disposable wiping products that have the appearance and feel of a cloth product.

Still another object of the present invention is to provide a cloth-like paper wiping product that is softer than many conventional products while still having comparable strength.

Another object of the present invention is to provide a method for producing a cloth-like base web by applying a bonding material to at least one side of a hydroneedled web and then creping at least one side of the web.

It is another object of the present invention to provide a cloth-like paper wiping product that is made by subjecting a base web to two different mechanical debonding steps.

Another object of the present invention is to provide a method for producing a base web by applying a bonding material to at least one side of a hydroneedled web and then creping at least one side of the web followed by at least one post-creping step, such as microcreping at least one side of the web or applying a solution to the web, in order to further enhance various properties of the web.

Still another object of the present invention is to provide a cloth-like base web that is soft, has improved absorbency, has good dry strength, has good wet strength, is tear-resistant, is abrasion-resistant, and retains its bulk when wet or dry.

These and other objects of the present invention are achieved by providing a method for forming a cloth-like base web that includes the steps of first hydroneedling a web containing pulp fibers, staple fibers, or mixtures thereof. Once the web is hydroneedled, a bonding material is then applied to at least one side of the web and at least one side of the web is then creped.

It has been discovered that hydroneedling the web prior to applying a bonding material increases the softness of the web and, of particular significance, gives the web the appearance and feel of a cloth product. Also of significance, it has been further unexpectedly discovered that the process of the present invention not only increases softness but also does not adversely affect the strength of the web in comparison to conventionally made base webs.

As used herein, hydroneedling a web refers to a process by which the web is subjected to a plurality of fluid jets. For instance, a process for hydroneedling pulp fiber webs is disclosed in U.S. Pat. No. 5,137,600 to Barnes, et al., which is incorporated herein by reference in its entirety. In Barnes, et al., a wet-laid non-woven web of pulp fibers is hydraulically needled on a wire mesh by a plurality of water jets.

In one preferred embodiment of the present invention, the bonding material, which can be a latex, is applied to both sides of the hydroneedled base web according to a preselected pattern and both sides of the base web are creped. The bonding material can be applied to each side of the web in an amount from about 2% to about 10% by weight. The bonding material, can be, for instance, an acrylate, a vinyl acetate, a vinyl chloride, or a methacrylate. In one embodiment, the bonding material is a cross-linked ethylene vinyl acetate.

The base web used to make the paper wiping products of the present invention can be made exclusively from wood pulp, such as softwood fibers, or can be made exclusively from staple fibers such as synthetic or natural fibers. In one embodiment, from about 5% to about 30% by weight of staple fibers can be mixed with wood pulp to form the web. For instance, the staple fibers can be relatively short synthetic fibers made from, for instance, polyolefins, polyester, nylon, polyvinyl acetate, cotton, rayon, or mixtures thereof. In an alternative embodiment, thermomechanical pulp can also be added to the base web.

Other fibers that may be added to the base web include curled fibers. The curled fibers can be curled either mechanically or chemically. Such curled fibers can include synthetic fibers, such as bicomponent fibers. It should be further understood that besides fibers, the base web can also contain filaments such as those that have been used to make spunbond webs.

When the base web contains primarily wood fibers, the base web can be hydroneedled by subjecting the web to columns of water at an energy level of about 0.002 to about 0.03 horsepower-hours per pound of dry web. For instance, the columnar flow of water used to hydroneedle the web can be forced through a series of nozzles having a diameter of about 0.003 inches to about 0.015 inches at a pressure of from about 50 psi to about 400 psi. When the base web of the present invention, however, contains synthetic fibers or fibers that are generally longer than pulp fibers, the columns of water can be at higher energy levels and at greater pressures during hydroneedling.

During the hydroneedling operation, the base web can be placed on a foraminous surface. The foraminous surface can be, for instance, a wire screen. Depending upon the particular application, the foraminous surface can have a mesh size ranging from coarse to fine. In one embodiment, the foraminous surface can be a fabric having an air permeability of at least 300 cubic feet per minute.

In most applications, base webs made according to the present invention can have a basis weight of from about 20 pounds per ream (pounds per 2,880 square feet) to about 70 pounds per ream. The base webs can contain a debonding agent added during the formation of the web in order to inhibit the pulp fibers from bonding together. Also, after the creping operation, a friction reducing agent can be applied to one or both sides of the web. Besides friction reducing agents, wet strength resins can also be applied to the web, such as epichlorohydran or a polyamide, or the web can be microcreped in order to further soften the web.

These and other objects of the present invention are also achieved by providing a cloth-like base web particularly well adapted to be used as a wiping product. The product is made from a hydroneedled web containing pulp fibers, staple fibers, or a mixture of pulp and staple fibers. As used herein, pulp fibers refer to wood fibers and other fibers used to make paper. Staple fibers, on the other hand, refer to all other types of fibers including non-woody plant fibers, synthetic fibers and natural fibers. The hydroneedled base web includes raised portions separated by channel-like portions. The raised portions have a swirled fiber structure created during the hydroneedling operation.

A bonding material is applied to at least one side of the base web in a preselected pattern and at least one side of the web is creped. In one preferred embodiment, the bonding material is applied to both sides of the web and both sides of the web are creped. When applied to the hydroneedled base web, the bonding material exists in greater concentrations within the channel-like portions on the web for providing strength. By arranging the hydroneedled fibers into channel-like arrays, the high capillarity of the fibrous network allows strategic location of the glue into the channel-like structures to enhance the effectiveness of the bonding material and thereby improve strength. Furthermore, this high capillarity structure is preserved through the creping operations by the Z directional fibers that bridge from the top adhesive layer to the bottom adhesive layer. Enhanced strength and abrasion resistance can also be assigned to this structure.

Other objects, features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the specification, including reference to the accompanying figures in which.

Figure 1:
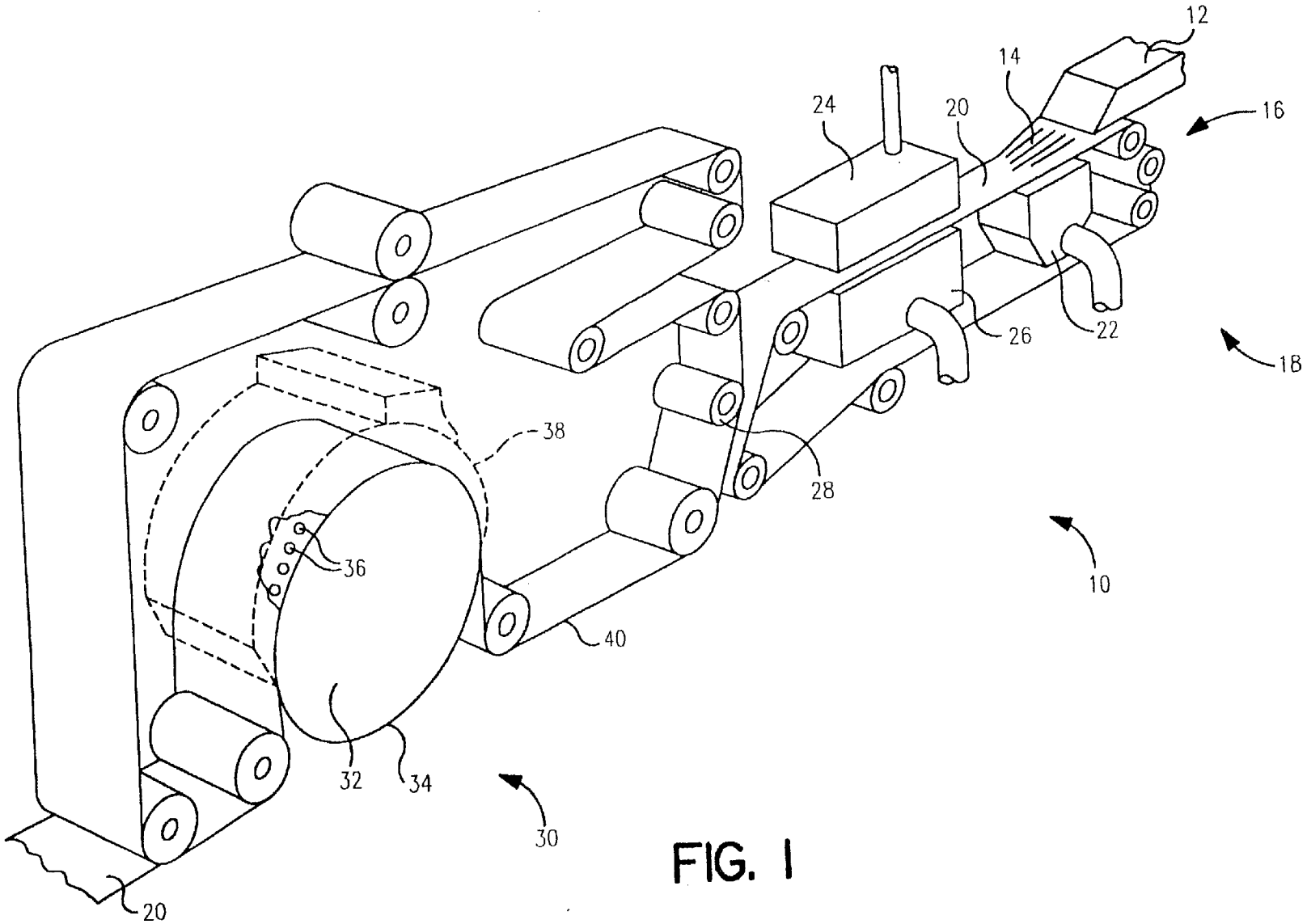
FIG. 1 is a illustration of one embodiment of a process for hydroneedling a web containing pulp fibers in accordance with the present invention.

Repeat use of reference characters in the present specification and drawings is intended to represent same or analogous features or elements of the present invention.

DETAILED DESCRIPTION OF PREFERRED EMBODIMENTS

It is to be understood by one of ordinary skill in the art that the present discussion is a description of exemplary embodiments only, and is not intended to limit the broader aspects of the present invention, which broader aspects are embodied in the exemplary construction.

In general, the present invention is directed to an improved method for creating a base web. The base web can be made from pulp fibers, staple fibers, and mixtures thereof. Of particular advantage, the base web made according to the process of the present invention has cloth-like properties. The base web can be used in the construction of many different types of products, including wiping products, garments, and other products that are intended to absorb fluids, such as diapers and feminine hygiene products.

In one embodiment, the present invention is directed to cloth-like paper wiping products and to a method of making the products. The wiping products, which can be used for residential or commercial use, have great softness and absorbency. Of particular significance, the wiping products have the appearance and feel of woven fabric. Specifically, the wiping products of the present invention have a cloth-like structure that resembles conventional linen and cloth wiping products. Further, the paper wiping products made according to the present invention feel like cloth when in use due to their ability to retain their bulk structure when wet.

Besides being soft and having a cloth-like feel and appearance, the wiping products of the present invention also have good strength characteristics either when wet or dry. The cloth-like wiping products further have good stretch characteristics, are tear-resistant and have good abrasion resistance.

The process of the present invention generally involves first forming a web of material containing pulp and/or staple fibers. The web can be wet formed or air formed depending on the particular application. The web of material is then hydroneedled by a plurality of columnar fluid jets, such as water jets. In one embodiment, the water jets contact the web of material while the material is positioned on a foraminous surface, such as a wire mesh.

Hydroneedling is a mechanical fiber re-arrangement process that causes fibers contained in the web of material to open up or loosen and rearrange. In particular, during hydroneedling, the fibers tend to swirl causing fibers laying in the X-Y plane of the web to rearrange into the Z direction, increasing the bulk of the web and the strength of the web in the Z direction. In addition, Z direction fibers enhance fluid transport. The force of the fluid jets against the foraminous surface also changes the appearance of the web to resemble a woven textile material. Fibers are rearranged along defined X - Y planes according to the superimposed topography of the foraminous wire mesh used as the backing during the hydroneedling process.

During hydroneedling, the fibers contained within the web, in some applications, may also undergo hydroentanglement. Hydroentangled webs, which are also known as spunlace webs, refer to webs that have been subjected to columnar jets of a fluid that cause the fibers in the web to entangle. Hydroentangling a web typically increases the strength of the web. In general, longer fibers, such as many staple fibers and filaments, will undergo hydroentanglement during a hydroneedling operation. Thus, according to the present invention, in order to increase the strength of a web, longer staple fibers can be added to the web in amounts sufficient for the staple fibers to hydroentangle during hydroneedling.

Once the web is hydroneedled, and dried, preferably on a through air dryer to retain bulk if desired properties are to be effectively preserved, a bonding material is applied to at least one side of the web and at least one side of the web is creped. The bonding material increases the strength and stretchability of the web. Creping, on the other hand, which is a mechanical debonding process, then serves to further increase the bulk and absorbency as well as the softness of the web. In one preferred embodiment, the bonding material is applied to both sides of the hydraulically needled web and both sides of the web are then creped.

The web of material used to make the wiping products of the present invention generally contains pulp fibers either alone or in combination with other types of fibers. The pulp fibers used in forming the web are preferably softwood fibers having an average fiber length of greater than 1 mm and particularly from about 2 to 5 mm based on a length weighted average. Such fibers can include Northern softwood kraft fibers, redwood fibers and pine fibers. Secondary fibers obtained from recycled materials may also be used.

In one embodiment, staple fibers (and filaments) can be added to the web to increase the strength, bulk, softness and smoothness of the web. Staple fibers can include, for instance, polyolefin fibers, polyester fibers, nylon fibers, polyvinyl acetate fibers, cotton fibers, rayon fibers, non-woody plant fibers, and mixtures thereof. In general, staple fibers are typically longer than pulp fibers. For instance, staple fibers typically have fiber lengths of 5 mm and greater.

The staple fibers added to the base web can also include bicomponent fibers. Bicomponent fibers are fibers that can contain two materials such as but not limited to in a side by side arrangement or in a core and sheath arrangement. In a core and sheath fiber, generally the sheath polymer has a lower melting temperature than the core polymer. For instance, the core polymer, in one embodiment, can be nylon or a polyester, while the sheath polymer can be a polyolefin such as polyethylene or polypropylene. Such commercially available bicomponent fibers include CELBOND fibers marketed by the Hoechst Celanese Company.

The staple fibers used in the base web of the present invention could also be curled or crimped. The fibers can be curled or crimped, for instance, by adding a chemical agent to the fibers or subjecting the fibers to a mechanical process. Curled or crimped fibers may create more entanglement and void volume within the web and further increase the amount of fibers oriented in the Z direction as well as increase web strength properties.

In general, base webs made according to the present invention can be made exclusively from staple fibers or can be made from a mixture of staple fibers and pulp fibers.

In one embodiment, when forming paper wiping products containing pulp fibers, the staple fibers can be added to the web in an amount from about 5% to about 30% by weight and particularly from about 10% to about 20% by weight.

In one preferred embodiment of a wiping product, short staple fibers made from a polyester or polyolefin are added to the web. For instance, the fibers can have a length of from about ¼ of an inch to about 1 inch. The fibers can be mixed homogeneously with the pulp fibers in forming the web. Staple fibers can increase the strength and softness of the final product.

When the base web of the present invention is not used to make paper wiping products, but instead is incorporated into other products such as diapers, feminine hygiene products, garments, personal care products, and various other products, the base web can be made from greater amounts of staple fibers. For example, the base web could be made entirely from staple fibers, such as cotton fibers, rayon fibers, or mixtures thereof. Meltblown fibers can also be incorporated into the base web. Further, besides fibers, filaments may also be added to the web. Such filaments can include, for instance, filaments made from synthetic materials such as the filaments that are typically used to produce spunbond webs.

Besides pulp fibers and staple fibers, thermomechanical pulp can also be added to the base web. Thermomechanical pulp, as is known to one skilled in the art, refers to pulp that is not cooked during the pulping process to the same extent as conventional pulps. Thermomechanical pulp tends to contain stiff fibers and has higher levels of lignin. Thermomechanical pulp can be added to the base web of the present invention in order to create an open pore structure, thus increasing bulk and absorbency and improving resistance to wet collapse.

When present, the thermomechanical pulp can be added to the base web in an amount from about 10% to about 30% by weight. When using thermomechanical pulp, a wetting agent is also preferably added during formation of the web. The wetting agent can be added in an amount less than about 1% and, in one embodiment, can be a sulphonated glycol.

One method for producing base webs in accordance with the present invention will now be discussed in detail. The following process will be particularly directed to producing base webs for use as wiping products, such as disposable paper wipers. It should be understood, however, that the process may be modified as appropriate to produce base webs that can be used in other various products.

In general, the base web of the present invention should be formed without substantial amounts of interfiber bond strength. In this regard, in one embodiment, the fiber furnish used to form the base web if containing pulp fibers can be treated with a chemical debonding agent. Suitable debonding agents that may be used in the present invention include cationic debonding agents such as fatty dialkyl quaternary amine salts, monofatty alkyl tertiary amine salts, primary amine salts, imidazoline quaternary salts, silicone quaternary salts, and unsaturated fatty alkyl amine salts. Other suitable debonding agents are disclosed in U.S. Pat. No. 5,529,665 to Kaun which is incorporated herein by reference. In particular, Kaun discloses the use of cationic silicone compositions as debonding agents.

In one preferred embodiment, a substantive debonding agent is used in the process of the present invention which refers to a debonding agent that adheres to the fibers and does not wash off when subjected to a hydroneedling process. For instance, one such debonding agent is an organic quaternary ammonium chloride and particularly a silicone based amine salt of a quaternary ammonium chloride. In general, the debonding agent can be added to the fiber slurry in an amount from about 0.1% to about 1% by weight, based on the total weight of fibers present within the slurry.

According to the process of the present invention, once a fiber furnish is selected, a fiber slurry is then formed into a web and the web is hydraulically needled. Referring to FIG. 1, one embodiment of a process 10 for forming a hydraulically needled, wet-laid non-woven web is illustrated. As shown, a dilute suspension containing fibers is supplied by a headbox 12 and deposited via a sluice 14 in uniform dispersion onto a foraminous surface 16 of a paper making machine 18.

Once deposited on foraminous surface 16, water is removed from web 20 by combinations of gravity, centrifugal force and vacuum suction depending upon the forming configuration. As shown in FIG. 1, a vacuum box 22 can be disposed beneath web 20 for removing water and facilitating formation of the web.

Once the fiber suspension is formed into web 20, web 20 is fed to a hydroneedling device 24 and hydroneedled on foraminous surface 16. Alternatively, the web may be transferred to a different foraminous surface for hydraulic needling or can even be dried and rehydrated prior to being hydroneedled.

As web 20 passes under hydroneedling device 24, the web is treated with a plurality of columnar jets of fluid to open up or loosen and rearrange the fibrous network. Hydroneedling device 24 in general contains at least one row of fluid jets that span the width of web 20. In one embodiment, the hydroneedling device can include two or three rows of fluid jets wherein the fluid jets can be offset from each other from row to row. Having multiple rows of fluid jets may create more fiber rearrangement and entanglement when web 20 contains relatively long fibers. Too many fluid jets contacting the web, however, may adversely interfere with the resulting strength of the web.

In general, web 20 is hydroneedled while the web still contains a substantial amount of water, such as at a consistency of from about 15% to about 45% solids, and particularly from about 25% to about 30% solids. It is believed that hydroneedling the web at the above specified consistencies allows the pulp fibers to be rearranged without interfering with hydrogen bonding since the pulp fibers are maintained in a hydrated state. The above solid consistencies also appear to provide optimum pulp fiber mobility. In particular, if the consistency of the web were too low, the fluid jets may tend to disintegrate web 20. If, on the other hand, the consistency of the web is too high, the fiber mobility decreases and the energy required to move the fibers increases resulting in higher energy fluid jet treatments which may tend to disintegrate the web 20.

In general, when containing pulp fibers, web 20 is hydroneedled by hydroneedling device 24 at relatively low pressures and energy levels. For instance, in most applications, the fluid jets impart from about 0.002 to about 0.03 horsepower-hour per pound of dry web as is disclosed in U.S. Pat. No. 5,137,600 to Barnes et al. as referenced above. Each of the fluid jets can be created by forcing a fluid, such as water, through a hole or orifice having a size generally from about 0.003 inches to about 0.015 inches in diameter. For example, the invention may be practiced utilizing a fluid jet manifold produced by Honeycomb Systems, Inc. of Biddford, Me., which contains a single row of 0.007 inch diameter orifices at a density of 30 holes per inch. Many other manifold configurations and combinations may be used however.

During the hydroneedling process, when producing webs containing primarily pulp fibers, the working fluid can pass through the orifices at a pressure ranging from about 50 psi to about 400 psi to form the fluid streams which impact web 20. More particularly, the fluid pressure for most applications is typically between from about 50 psi to about 200 psi.

The distance that the jet orifices are spaced from the web during the hydroneedling operation can vary. In general, the distance between the orifices and the web should be selected so that the fluid exiting the orifices remains columnar when contacting the web. When hydroneedling webs containing pulp fibers at the above described pressure ranges, the orifices can be, for instance, positioned from about 1 cm to about 5 cm above the web. The distance, however, will generally depend upon the particular application.

It should be understood that the above described pressure ranges for hydroneedling web 20 generally correspond to webs containing pulp fibers that are to be used as wiping products. In other applications, such as when forming different types of products, it should be understood that the pressure of the fluid contacting the web can be greatly varied. In general, the pressure of the fluid used to hydroneedle web 20 will depend upon a number of factors. For instance, the pressure of the fluid will depend upon the jet orifice size, the rate at which the web advances underneath the fluid jets, the basis weight of the web, and the make up of the web. For example, base webs made from primarily staple fibers may require higher fluid pressures in order for effective hydroentangling to occur if desired. For instance, base webs containing only staple fibers may require fluid pressures as high as 2,000 psi.

As shown in FIG. 1, a vacuum device 26 may be located directly beneath hydroneedling device 24 or beneath foraminous surface 16 downstream from hydroneedling device 24 so that excess water is withdrawn from web 20.

As described above, the fluid jets contained within hydroneedling device 24 directly impact pulp fibers laying in the X-Y plane of web 20 and rearrange some of the fibers into the Z direction, which increases the specific volume of the web, the strength of the web in the Z direction and enhances other properties and characteristics of the web.

Of particular importance, the fluid jets also wash the fibers contained in the web off knuckles, ridges or raised portions of foraminous surface 16. This washing action appears to create pores and/or apertures on the raised portions or knuckles of the foraminous surface as well as high density deposits of fibers in lower portions on the foraminous surface. The fluid jets are also believed to bounce or rebound from the foraminous surface which further serves to increase the interstitial spaces between the fibers contained within the web. The direct impact of the fluid jets, the washing action and the rebound effect of the jets, in combination, increase the porosity and mean flow pore size of the web, corresponding to increases in bulk and absorbency characteristics.

Of particular advantage, web 20, once hydroneedled, has the appearance of a woven cloth product. The fluid jets when contacting the web as described above cause fibers impacted by the fluid jets to swirl away from the flow of fluid. This swirling action creates raised portions in the web adjacent to the fluid jets. Where the fluid jets directly impinge upon the web, on the other hand, channel-like portions are formed. Thus, a pattern of raised portions and channel-like portions are created during the hydroneedling process which gives the web the appearance of a woven fabric product and increases the softness and absorbency of the web. Further, the swirled fibrous structure of the raised portions of the web do not become compressed when wet. By retaining a substantial amount of wet bulk, the base web of the present invention also has the feel of a cloth or fabric when used.

As shown in FIG. 1, after fluid jet treatment, web 20 may then be transferred to a drying operation. In one embodiment, a differential speed pick-up roll 28 may be used to transfer web 20 from foraminous surface 16 to a dryer 30.

Preferably, dryer 30 dries web 20 without applying a compressive force in order to maximize bulk. For example, as shown in FIG. 1, dryer 30 can be a rotary drum through-air drying apparatus 32. Through-air drying apparatus 32 includes an outer rotatable cylinder 34 with perforations 36 in combination with an outer hood 38. Specifically, a through-air dryer belt 40 carries web 20 over the upper portion of through dryer outer cylinder 34. Heated air is drawn through perforations 40 which contacts web 20 and removes moisture. In one embodiment, the temperature of the heated air forced through perforations 36 can be from about 170° F. to about 500° F.

As described above, through-air drying a web 20 can increase the bulk, absorbency and softness of the web while removing excess water. It should be understood, however, that other drying devices may be used in the process. For instance, in some applications where bulk is not critical, web 20 can also be wet pressed using, for example, a Yankee dryer.

Foraminous surface 16, as described above, facilitates the hydroneedling process and assists in providing web 20 with a cloth-like appearance. In general, foraminous surface 16, which can be a wire or fabric screen, should have a mesh size fine enough to avoid fiber wash out and yet allow adequate drainage. Further, since the base web generally conforms to the topography of the foraminous surface, the foraminous surface should have a mesh size that will provide the web with a textile-like appearance when desired. For example, the foraminous surface may be varied with different areas of drainage resistance, knuckle height, patterns, etc. to obtain varying quilt-like designs in the finished product.

Foraminous surface 16 can range from a fine mesh to a coarse mesh size. In general, coarser mesh sizes are preferred when creating wiping products. Specifically, it is believed that coarser mesh sizes tend to create a softer web that is less stiff. For instance, the foraminous surface used to create the paper web of the present invention can have a coarse mesh size such that the air permeability of the surface is at least 200 cubic feet per minute, and particularly at least 350 cubic feet per minute. One example, of a wire mesh that has been found particularly well adapted for use in the present invention has an air permeability of from about 350 cubic feet per minute to about 400 cubic feet per minute. As used herein, the air permeability of a foraminous surface is calculated using a Frazier method or similar method.

In one embodiment, foraminous surface 16 can have a layered construction, such as including a top coarse layer connected to a bottom fine layer. Also, if desired, foraminous surface 16 can include a pattern that varies in mesh size in order to modify the appearance of the web or to vary the characteristics of the web.

One particular foraminous surface that may be used in the present invention is 129T-4 wire available from Albany International, Engineered Fabrics/TSI of Portland, Tenn. 129T-4 wire includes a coarse layer having a mesh size of 44×35 connected to a fine layer having a mesh size of 85×70. When used in the present invention, preferably the base web is formed on the coarse layer when the base web contains pulp fibers. The air permeability of the wire is from about 250 cubic feet per minute to about 400 cubic feet per minute.

Another commercially available foraminous surface that may be used in the present invention is an 8 shed (H series)

high density single layer polyester wire having the following specifications:

| | |
|---|---|
| Mesh Size | 62 |
| Count | 20 |
| Warp Diameter | 0.50 mm |
| Shute Diameter | 0.78 mm |
| Air Permeability | 452 cfm |
| Caliper | 0.072 inches. |

Fabrics of this type may be obtained from Albany International, Engineered Fabrics/TSI.

Once web 20 is dried by dryer 30, the web can be wound onto a roll for processing later at a different location or, alternatively, can be continuously fed into further processing stations. once dried, according to the present invention, a bonding material is applied to at least one side of the web and at least one side of the web is then creped. For instance, in one preferred embodiment of the present invention, a bonding material is applied to both sides of the web and then either one or both sides of the web are creped.

Figure 2:
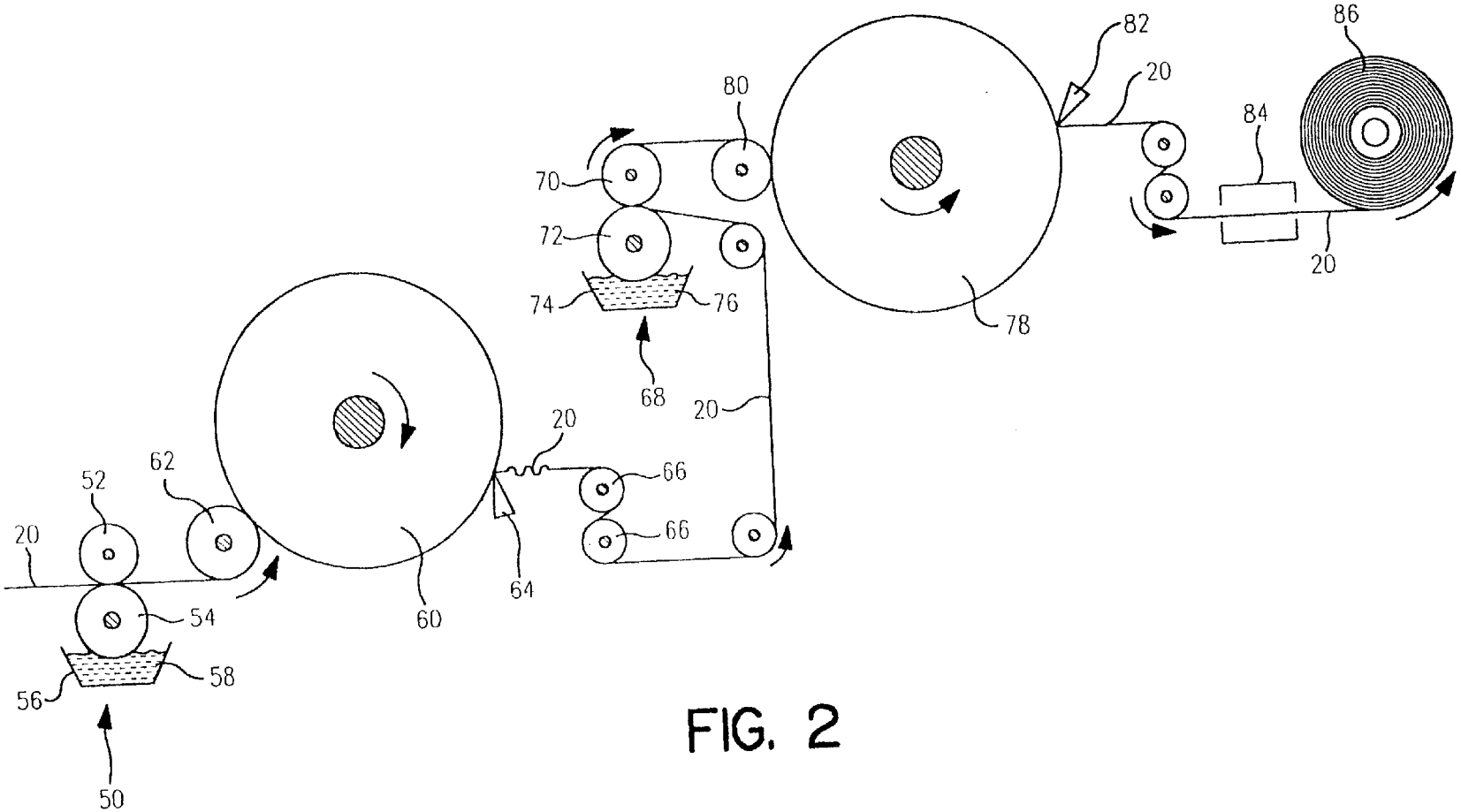
FIG. 2 is a schematic diagram of one embodiment of a process for double creping a paper web in accordance with the present invention.

Referring to FIG. 2, one embodiment of a process according to the present invention is illustrated that applies a bonding material to both sides of the paper web and for creping both sides of the web.

As shown, paper web 20 made according to the process illustrated in FIG. 1 or according to a similar process, is passed through a first bonding agent application station generally 50. Station 50 includes a nip formed by a smooth rubber press roll 52 and a patterned rotogravure roll 54. Rotogravure roll 54 is in communication with a reservoir 56 containing a first bonding agent 58. Rotogravure roll 54 applies bonding agent 58 to one side of web 20 in a preselected pattern.

Web 20 is then pressed into contact with a first creping drum 60 by a press roll 62. The web adheres to creping drum 60 in those locations where the bonding agent has been applied. If desired, creping drum 60 can be heated for promoting attachment between the web and the surface of the drum and for partially drying the web.

Once adhered to creping drum 60, web 20 is brought into contact with a creping blade 64. Specifically, web 20 is removed from creping roll 60 by the action of creping blade 64, performing a first controlled pattern crepe on the web.

Once creped, web 20 can be advanced by pull rolls 66 to a second bonding agent application station generally 68. Station 68 includes a transfer roll 70 in contact with a rotogravure roll 72, which is in communication with a reservoir 74 containing a second bonding agent 76. Similar to station 50, second bonding agent 76 is applied to the opposite side of web 20 in a preselected pattern. Once the second bonding agent is applied, web 20 is adhered to a second creping roll 78 by a press roll 80. Web 20 is carried on the surface of creping drum 78 for a distance and then removed therefrom by the action of a second creping blade 82. Second creping blade 82 performs a second controlled pattern creping operation on the second side of the paper web.

Once creped for a second time, paper web 20, in this embodiment, is pulled through a curing or drying station 84. Drying station 84 can include any form of a heating unit, such as an oven energized by infrared heat, microwave energy, hot air or the like. Drying station 84 may be necessary in some applications to dry the web and/or cure the first and second bonding agents. Depending upon the bonding agents selected, however, in other applications drying station 84 may not be needed.

The bonding agents applied to each side of paper web 20 are selected for not only assisting in creping the web but also for adding dry strength, wet strength, stretchability, abrasion resistance, and tear resistance to the paper. The bonding agents also prevent lint from escaping from the wiping products during use. Of particular advantage, once the bonding agents are applied to the web, the Z directional fibers contained in the web become secured to the top adhesive layer and to the bottom adhesive layer, which preserves the structure of the web and enhances strength and abrasion resistance.

As described above, the bonding agent is applied to the base web in a preselected pattern. In one embodiment, for instance, the bonding agent can be applied to the web in a reticular pattern, such that the pattern is interconnected forming a net-like design on the surface. For example, the bonding material can be applied according to a diamond shaped grid. The diamonds, in one embodiment, can be square having a length dimension of ¼ inch. In an alternative embodiment, the diamonds comprising the grid can have length dimensions of 60 mm and 90 mm.

In an alternative embodiment, the bonding agent can be applied to the web in a pattern that represents a succession of discrete dots. This particular embodiment is generally well suited for use with lower basis weight wiping products. Applying the bonding agent in discrete shapes, such as dots, provides sufficient strength to the web without covering a substantial portion of the surface area of the web. In particular, applying the bonding agents to the surfaces of the web can adversely affect the absorbency of the web. Thus, in some applications, it is preferable to minimize the amount of bonding agent applied.

In a further alternative embodiment, the bonding material can be applied to the web according to a reticular pattern in combination with discrete dots. For example, in one embodiment, the bonding material can be applied to the web according to a diamond shaped grid having discrete dots applied to the web within the diamond shapes.

According to the present invention, the bonding agent can be applied to each side of the paper web so as to cover from about 10% to about 60% of the surface area of the web. More particularly, in most applications, the bonding agent will cover from about 20% to about 40% of the surface area of each side of the web. The total amount of bonding agent applied to each side of the web will preferably be in the range of from about 2% to about 10% by weight, based upon the total weight of the web. Thus, when the bonding material is applied to each side of the web, the total add on will be from about 4% to about 20% by weight.

At the above amounts, the bonding agent can penetrate the paper web from about 20% to about 50% of the total thickness of the web. Greater penetration than 50% may also be desired when creating a multi-ply product. In most applications, the bonding agent should at least penetrate from about 10% to about 15% of the thickness of the web.

Particular bonding agents that may be used in the present invention include latex compositions, such as acrylates, vinyl acetates, vinyl chlorides, and methacrylates. Other bonding agents that may also be used include polyacrylamides, polyvinyl alcohols, and carboxymethyl cellulose. Further, non-latex adhesives, such as hot melt adhesives, may also be used. Hot melt adhesives may alleviate the necessity to dry the webs.

In one preferred embodiment, the bonding agent used in the process of the present invention comprises an ethylene vinyl acetate copolymer. In particular, the ethylene vinyl acetate copolymer is preferably cross-linked with N-methyl acrylamide groups using an acid catalyst. Suitable acid catalysts include ammonium chloride, citric acid, and maleic acid. The bonding agent should have a glass transition temperature of not lower than −10° F. and not higher than +10° F.

Figure 3:
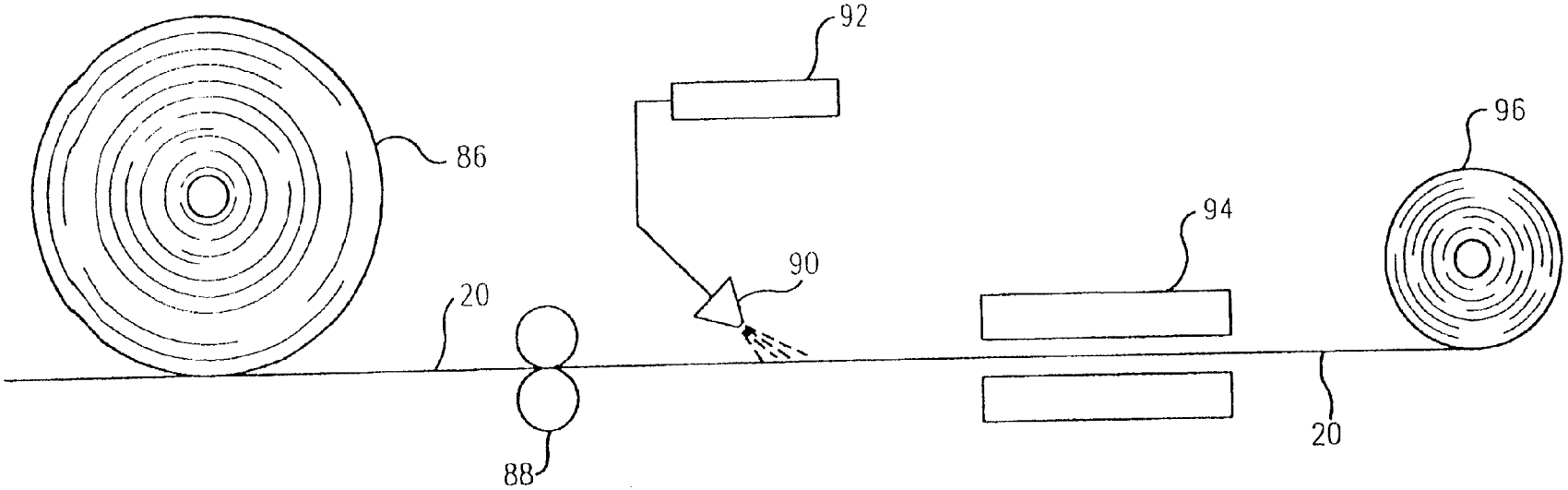
FIG. 3 is a schematic diagram of one embodiment of a process for applying a friction reducing agent to a paper web in accordance with the present invention.

After the bonding material is applied to the web and the web is creped, the web can then be ready for use as desired. Alternatively, however, further processing steps can be performed on the web. For instance, in one embodiment, the web can be calendered and then treated with a friction reducing agent in order to provide a web having a smooth, low friction surface. Referring to FIG. 3, one embodiment of a process for applying a friction reducing agent is illustrated.

As shown, the roll of material 86 formed according to the process illustrated in FIG. 2 is fed to a calendering machine 88. Calendering machine 88 can include two steel rolls designed to make the surfaces of web 20 smooth. Besides providing a web with smooth surfaces, calendering machine 88 also provides a uniform surface for facilitating application of a friction reducing agent. It should be understood, however, that calendering machine 88 can be eliminated from the process if it is important to preserve as much bulk as possible in web 20.

From calendering machine 88, web 20 is brought into contact with a sprayer 90 which applies a friction reducing composition to the web from a reservoir 92. Besides being sprayed on web 20, the friction reducing composition can also be printed on the web using a lithographic printing fountain. The friction reducing composition can be applied to either a single side of the web or to both sides of the web.

Once applied to web 20, the friction reducing composition increases the smoothness of the surface of the web and lowers friction. Some examples of friction reducing compositions that may be used in the process of the present invention are disclosed in U.S. Pat. No. 5,558,873 to Funk, et al., which is incorporated herein by reference.

In one preferred embodiment, the friction reducing composition applied is a quaternary lotion, such as a quaternary silicone spray. For instance, the composition can include a silicone quaternary ammonium chloride. One commercially available silicone glycol quaternary ammonium chloride suitable for use in the present invention is ABIL SW marketed by Goldschmidt Chemical Company of Essen, Germany.

In one embodiment, the friction reducing composition is applied to one side of the web in an amount from about 0.4% to about 2% by weight and particularly from about 0.4% to about 1.4% by weight, based upon the weight of the web.

After being sprayed with the friction reducing composition, web 20 is fed to a dryer 94, such as an infrared dryer. Dryer 94 removes any remaining moisture within the web.

As shown, the web can then be wound into a roll of material 96, which can be transferred to another location for packaging or for further processing.

Besides or in addition to being treated with a friction reducing composition, the base web made according to the present invention may also undergo various other post-creping operations, depending upon the particular application. For instance, in order to increase the softness of the web, the web can be microcreped. Microcreping is a mechanical softening step in which the web is creped from a creping drum, such as a Yankee drier, without the use of an adhesive.

The base web can also be treated with various solutions, such as flame retardency solutions, wet wipe solutions, lotions for producing a lotionized base sheet, etc. The base sheet can also be made "super absorbent", for instance, as disclosed in U.S. Pat. No. 5,328,759 to McCormick, et al., which is incorporated herein by reference.

Base sheets made according to the present invention can be incorporated into numerous products for commercial use. For instance, the base webs can be used in wiping products, diapers, feminine hygiene products, other personal care products, baby wipers, garments, or in various hospital products. In some applications, the base web of the present invention may be incorporated into a multi-ply product. When used in a multi-ply product, the basis weight of the base web can be relatively low.

In one embodiment, two base webs made according to the present invention are combined to form a two-ply product. In this embodiment, preferably the bonding agent is only applied to one side of each web. The base webs are then combined such that the adhesive sides of the web face outwards and that the non-adhesive sides of the web are placed adjacent to each other. If desired, once both webs are placed adjacent to each other, both plies can be mechanically embossed. In this embodiment, the two-ply product can be used, for instance, as a wiper.

Base webs made according to the above-described process provide many advantages and benefits over many products made in the past. Of particular advantage, the base webs of the present invention have the appearance and feel of a woven textile product. Further, in comparison to conventionally made hydroneedled products, the base web of the present invention has much more strength, has better stretch characteristics, and better abrasion resistance. The base webs also have better absorbency through improved pore size distribution which allows for better lateral wicking of liquids. Since the base web is creped after being hydroneedled, the web may even be softer (less stiff) than many hydroneedled products made in the past, especially if the web is microcreped as described above.

In comparison to conventionally made creped products, the base web of the present invention has a completely different look and feel that better resembles linens and cloths. Further, the base webs have improved wet bulk due to the swirled fiber structure and the Z directionally oriented fibers. Of particular advantage, the products of the present invention are softer than many conventionally made creped products while still retaining a high level of strength.

Figure 4A:
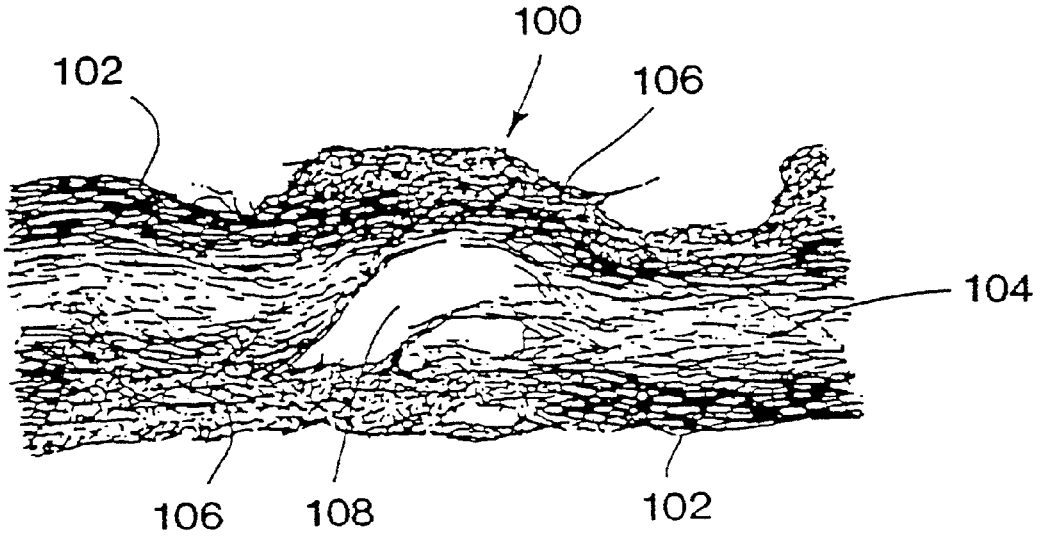
FIG. 4A PRIOR ART
FIG. 4A is an enlarged cross-sectional view of a portion of a prior art paper web.

One example of a prior art paper web generally 100 is illustrated in FIG. 4A. Paper web 100 is intended to represent a web that has been subjected to control pattern creping on both sides. Paper web 100 includes surface regions 102 and a central core region 104. The surface regions are generally undulating and have a bonding material 106 disposed at spaced locations. Bonding material 106 bonds at least some of the fibers together to form bonded web portions located throughout surface regions 102. Paper web 100 further includes split areas 108 in the central region of the web which is caused in part by a localized shrinkage of the bonded areas due to the creping action.

Figure 4B:
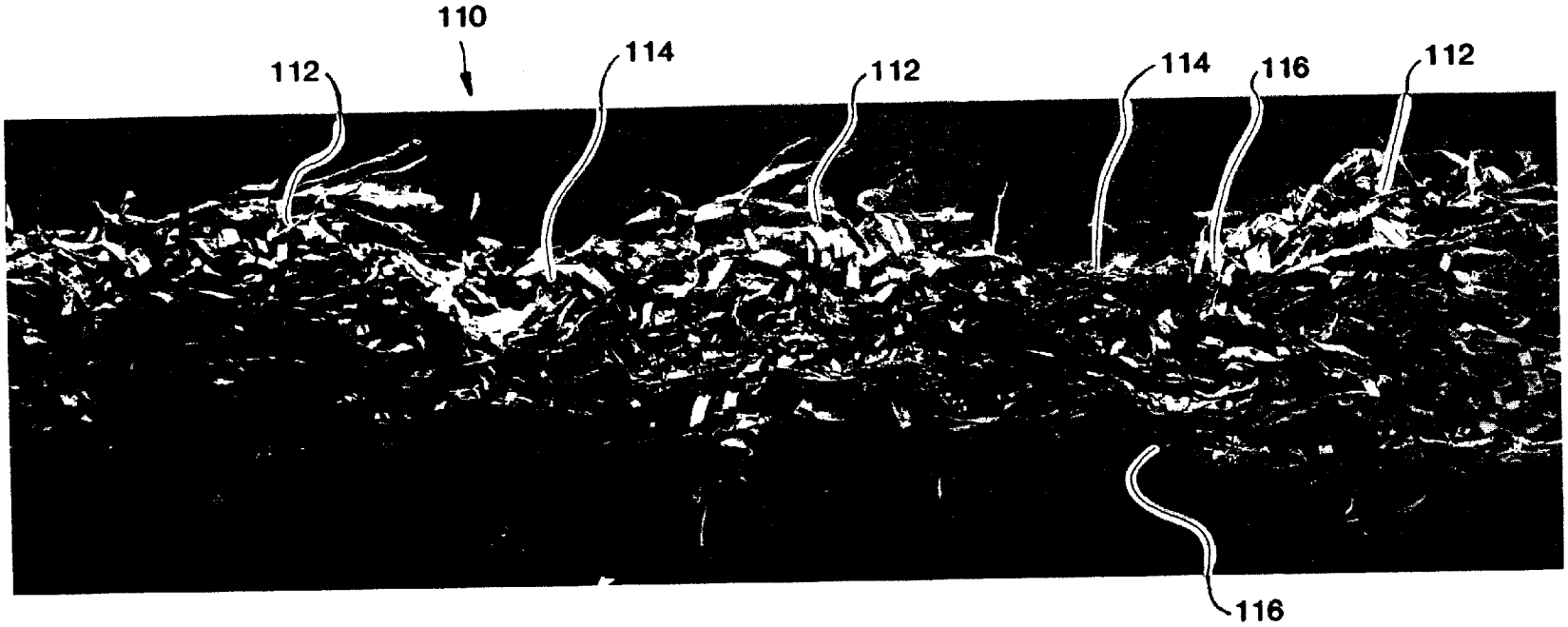
FIG. 4B is an enlarged cross-sectional view of a portion of a paper web made in accordance with the present invention.

In comparison to the paper web illustrated in FIG. 4A, FIG. 4B illustrates a web 110 made in accordance with the present invention. The web illustrated in FIG. 4B was drawn from a photomicrograph of an actual sheet that had been hydroneedled and then subjected to controlled pattern creping on both sides.

As shown, the construction of web 110 is much different in appearance in comparison to the construction of paper web 100 as shown in FIG. 4A. Web 110 includes raised portions 112 spaced between channel-like portions 114. As described above, when base web 110 is hydroneedled, channel-like portions 114 are formed where the fluid jets directly impinge upon the web. The fluid jets also cause fibers laying adjacent to channel-like portions 114 to swirl creating raised portions 112, wherein fibers have been reoriented into the Z direction. The pattern of raised portions 112 and channel like portions 114 give web 110 the appearance of a woven fabric. Further, raised portions 112 provide softness to the web and, due to their structure, provide the web with a substantial amount of wet bulk and absorbency.

Besides being hydroneedled, base web 110 has also been subjected to a controlled pattern crepe on both sides of the web. In this regard, web 110 further includes a bonding material 116 that has been applied to both surfaces of the web. Bonding material 116 tends to accumulate within channel-like portions 114 when applied to the web. In this manner, bonding material 116 reenforces the spaces between raised portions 112 and greatly increases the strength of the web. The bonding material also adheres to both ends of the Z directional fibers contained within the web for creating a resilient fiber structure. Bonding material 116 provides the hydroneedled base web with sufficient strength and elasticity to allow paper web 110 to be used in various applications, such as a wiping product.

The basis weight of paper wiping products made according to the present invention can generally range from about 20 pounds per 2,880 sq. feet (ream) to about 70 lbs/ream, and particularly from about 30 lbs/ream to about 50 lbs/ream. Further, for some applications basis weights higher than 70 lbs/ream may also be constructed. In general, lower basis weight products are well suited for use as paper towels while the higher basis weight products are better adapted for use as industrial wipers and for other types of liquid absorbent products.

The present invention may be better understood with reference to the following examples.

EXAMPLE NO. 1

The following tests were performed in order to compare the differences between wiping products made according to the present invention and conventionally made wiping products. More particularly, creped wiping products made from a hydroneedled base web were compared with creped wiping products that were not hydroneedled.

Four (4) different wiping products were produced and tested. The results of the tests are contained in Table 1 below. All of the samples tested were made from 100% Northern softwood kraft fibers. The base web used to make the samples was formed according to a wet lay process and then through-air dried.

Once the base web was formed, a bonding material was printed on each side of the web and both sides of the web were creped similar to the process illustrated in FIG. 2. The bonding material used was a cross-linked ethylene vinyl acetate latex obtained from Air Products, Inc. of Allentown, Pa.

In Samples 1 and 2 the latex bonding material was applied according to a ¼ inch diamond pattern in combination with an over pattern of dots. The bonding material was applied to the base web in an amount of 12% by weight.

In Samples 3 and 4, on the other hand, the bonding material was applied according to a 60 mm×90 mm diamond pattern. The total add on of the bonding material was also 12% by weight.

Samples 1 and 3, which were made according to the present invention, were hydroneedled prior to being through dried. Specifically the base webs were hydroneedled similar to the process illustrated in FIG. 1. During the hydroneedling process, the base web was subjected to a manifold containing one row of fluid nozzles having tapered jet orifices. The orifices had a diameter of 0.07 inches. The manifold contained 30 orifices per linear inch. The fluid nozzles emitted columnar jets of water that contacted the base web at a pressure of from about 80 psig to about 85 psig. The line speed was about 50 ft/min.

In this experiment, the base web was hydroneedled on a two layered foraminous surface or wire. The high knuckle side of the wire was in direct contact with the hydroneedled base web. Specifically, the foraminous surface used was a PRO-47 wire obtained from the Lindsey Wire Company of Appleton, Wisconsin and had the following characteristics:

| | |
|---|---|
| Mesh | 76 × 38 |
| Count | 88 × 44 |
| Weave | Oval Wrap Double Layer |
| Machine Direction | 0.0067" Top |
| Strand | 0.008" × 0.013" Oval Bottom |
| Cross Direction | 0.0050" Top |
| Strand | 0.0118" Bottom |
| Air Permeability | 295 CFM |
| Caliper | 0.0375" |

The following results were obtained:

TABLE 1

Comparison of Hydroneedled and Creped Base Webs to Creped Base Webs That Were Not Hydroneedled

| Sample No. | Hydro-Needled 1 | Prior Art 2 | Hydro-Needled 3 | Prior Art 4 |
|---|---|---|---|---|
| Basis Weight (lb/ream) | 55 | 48 | 54 | 51.5 |
| Bulk (8 plys) (0.001") | 881 | 841 | 863 | 800 |
| Machine Direction Tensile Strength (oz/in) | 106 | 59 | 88.6 | 56 |
| Machine Direction Stretch (%) | 22.5 | — | 19.8 | 38 |
| Cross-Direction Tensile Strength (oz/in) | 43.8 | 33 | 38.3 | 39 |
| Cross-Direction Stretch (%) | 15 | — | 11.8 | — |
| Cross-Direction Wet Tensile Strength (oz/in) | 26.8 | 23.4 | 25.1 | 24.5 |
| Taber (cycles) | 47 | 32 | 48 | 38 |
| Wipe Dry ($cm^2$) | 63 | 185 | 330 | — |
| Z dir wick (g water/g fiber/sec) | 1.029 | 0.713 | 1.133 | 1.153 |
| XY dir wick (g water/g fiber/sec) | 0.59 | 0.44 | 0.625 | 0.419 |
| Lint (No. of particles/10 micron screen) | 121 | 165 | 226 | 147 |
| Machine Direction Tear (lbs) | 1.2 | 0.69 | 0.84 | 0.67 |
| Cross-Direction Tear (lbs) | 1.1 | 0.67 | 0.62 | 0.56 |
| Total Water Capacity (g water/g product) | 6.1 | 6.16 | 6.55 | 6.15 |

The above tests performed on the samples were done according to conventional methods which are well known in the art. From the above table, Taber refers to an abrasion test that determines how many cycles it takes for a paper wiping product to develop a ½ inch hole. The wipe dry test above determines the area of a 1.5 ml pool of water that will be absorbed by a sheet of a paper wiping product having a particular size.

During this experiment, it was observed that Sample Nos. 1 and 3, which were made according to the process of the present invention, had a much more cloth-like appearance and feel than Sample Nos. 2 and 4 made according to conventional methods. As shown in the table, the base webs made according to the present invention also generally had better overall strength and tear properties than the conventional products. It was noticed, however, that Sample Nos. 1 and 3 tended to be somewhat stiffer than Sample Nos. 2 and 4. As shown in Example 2, it is believed that this result occurred because the base webs used to make Sample Nos. 1 and 3 were hydroneedled on a foraminous surface having a relatively fine mesh size. It is believed that the softness of base webs made according to the process of the present invention can be increased if a more coarse wire screen is used as the foraminous surface.

EXAMPLE NO. 2

The following tests were also performed in order to compare the differences between wiping products made according to the present invention with prior art creped wiping products.

In this example, two different wiping products were produced and tested. The results of the tests are contained in Table 2 below. Both of the samples tested were made from Northern softwood pulp. The base web used to make the samples was formed according to a wet lay process and then through-air dried.

In both samples that were produced, a bonding material was printed on each side of the base web and both sides of the web were creped similar to the process illustrated in FIG. 2. The bonding material used was an ethylene vinyl acetate latex having a viscosity of 100 cps and 38% solids. The bonding material was applied in a 60×90 millimeter diamond pattern using gravure rolls at 20 psi print pressure. The base web was fed through the gravure rolls at 100 feet per minute.

In this embodiment, the base sheet also contained about 1% by weight of a quaternary ammonium chloride salt debonding agent and about 0.08% of a paper wetting agent.

Sample No. 2 appearing in Table 2 below was made according to a prior art process in which after the bonding material was applied to the web, the web was creped on both sides.

Sample No. 1 appearing in Table 2 below, however, was made according to the process of the present invention. Specifically, this sample was hydroneedled prior to being through dried and double creped. In particular, the base web was hydroneedled using the 7/30/1 columnar fluid jets as described in Example No. 1 at a pressure of about 85 psig. The line speed was about 50 ft/min.

The base web was hydroneedled on a foraminous surface that had a coarser mesh size than the foraminous surface used in Example 1 above. Specifically, the foraminous surface used was fabric style 129T-4 obtained from Albany International, Engineered Fabrics/TSI of Portland, Tenn. The foraminous surface was a layered fabric having the following characteristics:

| | |
|---|---|
| Top Coarse Mesh Size | 44 × 35 |
| Bottom Fine Mesh Size | 85 × 70 |
| Air Permeability | 350–400 CFM |
| Caliper | 0.033"–0.034" |
| Top Warp | 0.66 mm |
| Bottom Warp | 0.17 mm |

-continued

| | |
|---|---|
| Top Shute | 0.30 mm |
| Bottom Shute | 0.15 mm |

35 Binder Strands per inch at 0.11 mm

The 129T-4 wire was positioned so that the rough, high knuckle side wire surface was next to the hydroneedled base web in order to produce a high profiled textured sheet.

The following results were obtained:

TABLE 2

Comparison of a Hydroneedled Base Web Made According to the Present Invention to a Conventionally Made Creped Web

| Sample No. | Hydro-Needled 1 | Prior Art 2 |
|---|---|---|
| Basis Weight (lb/ream) | 46.9 | 49.3 |
| Bulk (8 plys) (0.001") | 567 | 561 |
| Machine Direction Tensile Strength (oz/in) | 63 | 69 |
| Machine Direction Stretch (%) | 21% | 42% |
| Cross-Direction Tensile Strength (oz/in) | 29 | 37 |
| Cross-Direction Stretch (%) | 18 | 15 |
| Cross-Direction Wet Tensile Strength (oz/in) | 21.3 | 21 |
| Cross direction wet stretch (%) | 20% | 15% |
| Cross direction tensile in isopropyl alcohol (oz/in) | 12 | 16 |
| Cross direction stretch in isopropyl alcohol (oz/in) | 13% | 9% |
| Handfeel | very soft, cloth like | smooth, not cloth-like |
| Appearance | looks like a linen towel | smooth wiper |
| Bending stiffness (centimeter overhang for a 45° drop) (measure of softness or flexibility) | | |
| -machine direction | 7.7 | 8.7 |
| -cross direction | 7.8 | 9.4 |

In the above table, the bending stiffness test was conducted by extending a piece of the base web out over an overhang for a distance until the base web formed a 45° angle with the overhang.

As shown above, in this example, when using a coarser foraminous surface, the base web made in accordance with the present invention was less stiff than the prior art wiping product. As shown above, the hydroneedled product made according to the present invention subjectively has enhanced linen-like or cloth-like aesthetic properties in comparison to a wiping product that has not been hydroneedled. As shown in the bending stiffness test, the base web wiping product of the present invention is softer without loss of bulk and is comparable in strength and stretch characteristics.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A base web comprising:

a hydroneedled, single layered fibrous web having a first side and a second side, said web being hydroneedled an amount sufficient to form a swirled fiber structure, to increase the strength of the web in the z -direction and to increase the specific volume of the web; and a bonding material applied to at least said first side of said web according to a predetermined pattern, at least said first side of said web being creped after application of said bonding material, said first side of said web being creped where said bonding material has been applied to said web.

2. A base web as defined in claim 1, wherein said bonding material has been applied to said first side of said web and to said second side of said web in a preselected pattern, and wherein both sides of said web have been creped.

3. A base web as defined in claim 1, wherein said fibrous web contains pulp fibers.

4. A base web as defined in claim 3, wherein said fibrous web further contains staple fibers present in an amount up to about 30% by weight.

5. A base web as defined in claim 1, wherein said fibrous web is made exclusively from staple fibers.

6. A base web as defined in claim 1, wherein said hydroneedled fibrous web includes raised portions separated by channel-like portions, said raised portions having a swirled fiber structure.

7. A base web as defined in claim 2, wherein said fibrous web includes fibers oriented in the Z direction, said fibers being attached at one end to said bonding material along said first side of said web and said fibers being attached at an opposite end to said bonding material along said second side of said web.

8. A base web as defined in claim 1, wherein said base web has a basis weight of from about 20 pounds per 2,880 sq. feet to about 70 pounds per 2,880 sq. feet.

9. A base web as defined in claim 1, wherein said fibrous web contains continuous filaments.

10. A cloth-like base web comprising:

a hydroneedled, single layered web containing fibers, said web having a first side and a second side, said hydroneedled web including raised portions separated by channel-like portions, said raised portions having a swirled fiber structure, said web being hydroneedled an amount sufficient to increase the strength of the web in the −z direction and to increase the specific volume of the web;

a bonding material applied to at least one side of said web in a preselected pattern; and wherein said at least one side of said web has been creped according to said preselected pattern.

11. A cloth-like base web as defined in claim 10, wherein said bonding material is applied to said base web in a manner such that greater concentrations of said bonding material are found within said channel-like portions.

12. A cloth-like base web as defined in claim 10, wherein said bonding material is applied to said first side of said web and to said second side of said web.

13. A cloth-like base web as defined in claim 12, wherein said first side of said base web is creped and said second side of said base web is creped.

14. A cloth-like base web as defined in claim 10, wherein said bonding material is applied to said at least one side of said base web in an amount from about 2% to about 10% by weight, said bonding material comprising a latex.

15. A cloth-like base web as defined in claim 10, wherein said base web comprises pulp fibers, staple fibers or mixtures thereof.

16. A cloth-like base web as defined in claim 15, wherein said base web further comprises thermomechanical pulp, said thermomechanical pulp being present in said base web in an amount from about 10% to about 30% by weight.

17. A cloth-like base web as defined in claim 10, wherein said base web has a basis weight of from about 20 pounds per 2,880 sq. feet to about 70 pounds per 2,880 sq. feet.

18. A method for forming a cloth-like base web comprising the steps of:

providing a single-layered web made from fibers;

hydroneedling said web on a foraminous surface in an amount sufficient to increase the strength of the web in the −z direction and to increase the specific volume of the web;

applying a bonding material to at least one side of said web according to a predetermined pattern; and creping said at least one side of said web according to where the bonding material has been applied.

19. A method as defined in claim 18, wherein said bonding material is applied to a first side of said web and to a second and opposite side of said web.

20. A method as defined in claim 19, wherein said first side of said web and said second side of said web are creped.

21. A method as defined in claim 18, wherein said bonding material comprises a latex.

22. A method as defined in claim 18, wherein said bonding material is applied to said at least one side of said web in an amount from about 2% to about 10% by weight.

23. A method as defined in claim 18, wherein said web is comprised of at least 60% by weight pulp fibers.

24. A method as defined in claim 23, wherein said web further comprises staple fibers.

25. A method as defined in claim 18, wherein said web is comprised primarily of staple fibers.

26. A method as defined in claim 25, wherein said staple fibers comprise a material selected from the group consisting of cotton, rayon, and mixtures thereof.

27. A method as defined in claim 18, wherein said web is hydroneedled with columnar jets of water.

28. A method for forming a base web comprising the steps of:

providing a single-layered web containing fibers, said web having a first side and a second side;

hydroneedling said web on a foraminous surface in an amount sufficient to increase the strength of the web in the −z direction and to increase the specific volume of the web;

drying said web;

applying a bonding material to said first side of said web in a preselected pattern, said bonding material being added to said first side in an amount from about 2% to about 10% by weight of said web, said bonding material being used to adhere said first side of said web to a first creping surface according to said preselected pattern;

creping said first side of said web from said first creping surface;

applying said bonding agent to said second side of said web in a preselected pattern, said bonding agent being added to said second side in an amount from about 2% to about 10% by weight of said web, said bonding material being used to adhere said second side of said web to a second creping surface; and creping said second side of said web from said second creping surface.

29. A method as defined in claim 28, wherein said web comprises at least 60% by weight pulp fibers.

30. A method as defined in claim 29, wherein said web further contains staple fibers in an amount up to about 30% by weight, said staple fibers comprising a material selected from the group consisting of polyolefins, polyester, nylon, polyvinyl acetate, cotton, rayon, and mixtures thereof.

31. A method as defined in claim 28, wherein said bonding material comprises a material selected from the group consisting of an acrylate, a vinyl acetate, a vinyl chloride, and a methacrylate.

32. A method as defined in claim 28, wherein said web is hydroneedled by being subjected to columnar jets of water, said jets of water being created by forcing said water through a series of nozzles having a diameter of from about 0.003 inches to about 0.015 inches.

33. A method as defined in claim 28, wherein said foraminous surface includes areas of varying air permeability to create varying areas of density in said web.

34. A method as defined in claim 28, further comprising the step of applying a friction reducing agent to at least one side of said web.

35. A method as defined in claim 28, wherein said foraminous surface comprises a fabric having an air permeability of at least 300 cubic feet per minute.

36. A cloth-like paper product comprising:

a hydroneedled, single-layered web containing pulp fibers, said web having a first side and a second side, said web being hydroneedled an amount sufficient to increase the strength of the web in the –z direction and to increase the specific volume of the web;

a bonding material applied to said first side of said web and to said second side of said web in a preselected pattern, each side of said web being creped according to where the bonding material has been applied; and wherein said cloth-like wiping product has a basis weight of from about 20 pounds per 2,880 sq. feet to about 70 pounds per 2,880 sq. feet.

37. A cloth-like product as defined in claim 36, wherein said web further comprises staple fibers, said staple fibers being present in said web in an amount up to about 30% by weight.

38. A cloth-like product as defined in claim 36, wherein said bonding material has been applied to each side of said web in an amount from about 2% to about 10% by weight.

39. A cloth-like product as defined in claim 36, wherein said hydroneedled web includes raised portions separated by channel-like portions, said raised portions having a swirled fiber structure.

40. A cloth-like product as defined in claim 39, wherein said raised portions include fibers oriented in a Z direction having a first end attached to said bonding material along said first side of said web and having a second and opposite end attached to said bonding material along said second side of said web.

41. A cloth-like product as defined in claim 36, wherein said bonding material comprises a latex.

42. A base web as defined in claim 1, wherein said fiberous web has been hydroneedled on a foraminous surface in a manner such that an impression of said foraminous surface is transferred to said first side of said web, said impression remaining visible after said first side has been creped.

43. A method as defined in claim 18, wherein said web is hydroneedled on said foraminous surface in a manner such that an impression of said foraminous surface is transferred to said one side of said web, said impression remaining visible after the side of the web has been creped.

44. A method as defined in claim 28, wherein said web is hydroneedled on said foraminous surface in a manner such that an impression of said foraminous surface is transferred to said first side of said web, said impression remaining visible after first side of said web has been creped.

* * * * *